United States Patent [19]

Staples

[11] Patent Number: 4,578,914

[45] Date of Patent: Apr. 1, 1986

[54] INTERIOR WALL CONSTRUCTION

[76] Inventor: Wesley Staples, P.O. Box 149, Palatka, Fla. 32077

[21] Appl. No.: 736,817

[22] Filed: May 22, 1985

Related U.S. Application Data

[63] Continuation-in-part of Ser. No. 503,354, Jun. 10, 1983.

[51] Int. Cl.[4] ..... E04B 2/82

[52] U.S. Cl. ..... 52/221; 52/238.1; 52/585; 52/264

[58] Field of Search ..... 52/264, 220, 221, 580, 52/585, 90, 92, 586, 238.1; 174/48, 49; 249/192

[56] References Cited

U.S. PATENT DOCUMENTS

| | | | |
|---|---|---|---|
| 352,011 | 11/1886 | Shelton | 52/92 |
| 1,013,632 | 1/1912 | Witthoefft | 249/192 |
| 1,689,642 | 10/1928 | Rappleyea . | |
| 1,830,382 | 11/1931 | Bemis | 52/585 |
| 2,034,215 | 3/1936 | Stencel . | |
| 2,140,772 | 12/1938 | Slayter et al. | 52/586 |
| 2,459,044 | 1/1949 | Pirz | 249/192 |
| 2,642,646 | 1/1953 | Johnston | 249/192 |
| 2,766,488 | 10/1956 | Danielson | 52/580 |
| 3,884,002 | 5/1975 | Logie . | |
| 4,068,434 | 1/1978 | Day et al. | 52/220 |
| 4,208,850 | 6/1980 | Collier . | |
| 4,219,978 | 9/1980 | Brown . | |
| 4,272,930 | 6/1981 | Foster . | |

FOREIGN PATENT DOCUMENTS

| | | | |
|---|---|---|---|
| 600606 | 4/1948 | United Kingdom | 249/192 |

*Primary Examiner*—James L. Ridgill, Jr.

*Attorney, Agent, or Firm*—Kerkam, STowell, Kondracki & Clarke

[57] ABSTRACT

An interior wall for a housing structure comprises a frame having top and bottom plates and a pair of vertical end studs which extend between the top and bottom plates. The internal wall also has a plurality of internal vertical studs inwardly of the pair of end studs. Wall coverings are provided on each face of the frame and the bottom plate is bored to receive wooden dowels which are attached to a dead wall floor stud affixed to a floor of the housing structure.

2 Claims, 9 Drawing Figures

INTERIOR WALL CONSTRUCTION

CROSS REFERENCE TO RELATED APPLICATION

This application is a continuation-in-part of my application Ser. No. 503,354 for Modular Housing Construction and Product filed on June 10, 1983.

THE INVENTION

This invention relates to method and means for manufacture and use of an assembly for internal walls in a housing structure. In my copending application a modular housing construction is disclosed and claimed in which all basic components of a building are prefabricated at a factory or shop and simply errected at the site with a minimum of on-the-site construction. The various wall panels and floor panels are connected by a wedge lock structure extending between modular units.

The present invention comprises an improvement in construction of the interior walls of, for example, a housing structure wherein panels forming the walls are connected to the floor and exterior walls or other interior walls through the medium of dowels carried by certain of the elements and received in predrilled bores in other elements of the modular wall construction.

It is known in the prior art to form interior and exterior modular wall units which are connected together at the site of the building structure by means of pin connectors and exemplary of patents showing such structures are U.S. Pat. Nos. 4,272,930—Foster; 4,219,978—Brown; 3,884,002—Logie; 2,034,215—Stencel; and 1,689,642—Rappleyea.

BRIEF SUMMARY OF THE INVENTION

An internal wall for a housing structure having a foundation, floor and exterior walls. The internal wall comprising a frame consisting of top and bottom wood plates, a pair of vertical wood end studs attached to an extending between the top and bottom plates and a plurality of internal vertical wood studs extending between the top and bottom plates inwardly of the pair of end studs. The internal wall may include electrical boxes attached to selected studs and electric wires running to the boxes and extending externally of the internal wall. Wall coverings are provided on each face of the frame and wood dowel receiving openings are provided in at least the bottom plate. A dead floor stud attached to the floor along the extent of each interior wall and wood dowels project upwardly from the dead floor stud sized and spaced to be received in the bottom plate of the interior wall.

BRIEF DESCRIPTION OF THE DRAWINGS

The invention will be more particularly described in reference to the accompanying drawings herein.

DETAILED DESCRIPTION OF THE INVENTION

Figure 1:
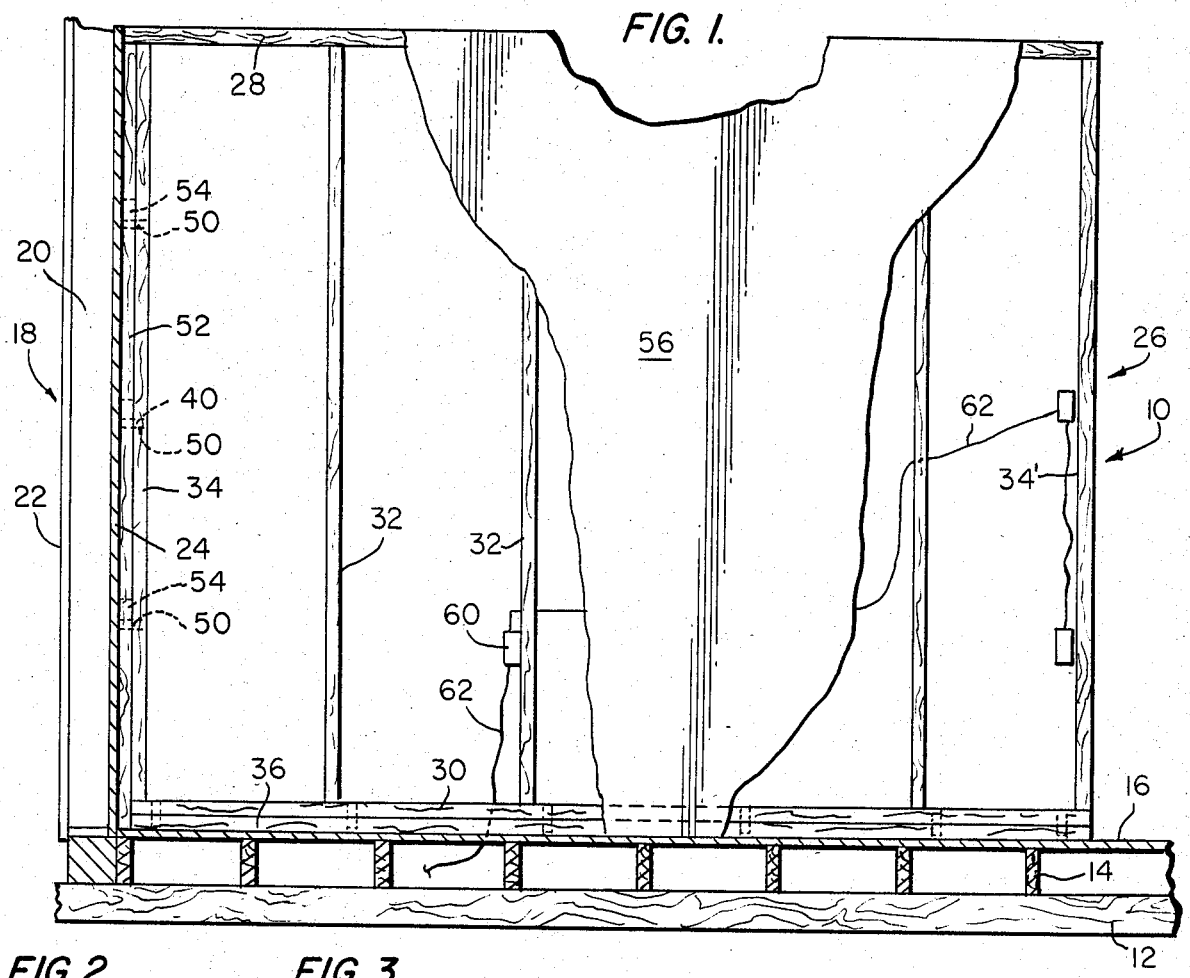
FIG. 1 is a fragmentary view of a partition wall constructed in accordance with the teachings of the invention positioned adjacent a floor and exterior wall panel.

Referring to the drawing and particular FIG. 1, 10 generally designates a portion of a housing structure including a sill 12, floor joist 14, a floor 16 and an exterior wall panel structure 18. The exterior wall panel 18 is of usual construction and includes studs 20, an exterior wall covering 22, and for example, interior dry wall 24.

All of the above deliniated structures are of conventional form. The improvement of the present invention is the interior wall construction generally designated 26. The interior wall construction 26 comprises a frame composed of top 28 and bottom 30, wood plates, a plurality of vertical wood studs 32 and a pair of vertical wood end studs 34 and 34' which extend vertically between the top and bottom plates 28 and 30. The number of a vertical internal wood studs 32 depends on the size of the internal wall and of course the spacing between the studs. The studs 32, 34 and 34' are constructed of 2×4's or equivalents as is known in the art.

The assembly also includes a dead floor stud 36 which is nailed to the floor 16 where the interior wall 26 is to be positioned. The length of the dead floor stud 36 is the same as the length of the bottom plate 30 of the panel 26.

Figure 6:
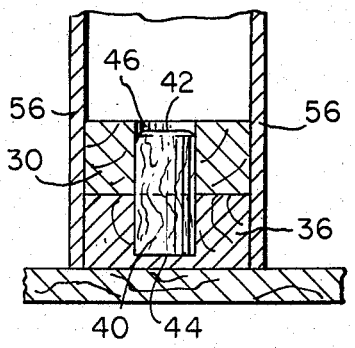
FIG. 6 is a fragmentary sectional view of a panel constructed in accordance with the present invention in conjunction with a portion of a dead floor stud and floor.
Figure 7:
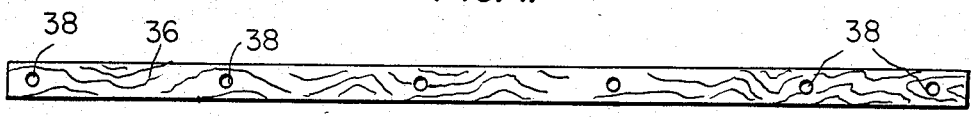
FIG. 7 is a face view of a partition bottom plate or dead floor stud.

The dead floor stud is provided with a plurality of through holes as shown for example in FIG. 7 and designated 38. The through holes 38 are sized to receive dowels such as dowel 40 shown in FIG. 6. The dowels 40 have rounded upper ends 42 and the dowels may be secured in the dead floor studs 36 with nails or by glueing with the upper portion projecting above the dead floor studs and the lower end 44 flushed with the bottom face of the stud 36.

As is shown in FIGS. 1 and 6 the length of the dowels 40 is such that when the bottom plate is positioned on top of the dead floor stud 36 the dowels do not project entirely through the bottom plate 30 which is bored as at 46 at each position of a dead floor stud dowel.

In a preferred form of the present invention the dowels 40 have a length of $2\frac{1}{2}$ inches and are sized to be received in a bore $1\frac{3}{8}$ inches. Further, the partition bottom plate bores may or may not comprise through holes and where they do not comprise through holes the bores 46 have a depth of $1\frac{1}{4}$ inches.

Further in a preferred form of the invention the centers of the bores 38 are 18 inches apart with the end bores being 3 inches from the end of the dead floor stud.

Figure 3:
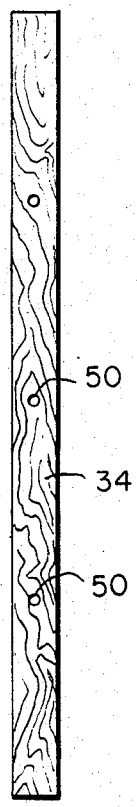
FIG. 3 is a face view of a partition stud.
Figure 4:
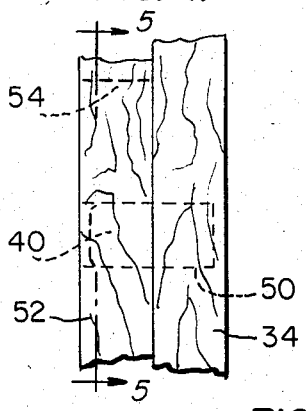
FIG. 4 is an enlarged fragmentary view of a portion of a vertical dead will stud and a partition end stud.
Figure 8:
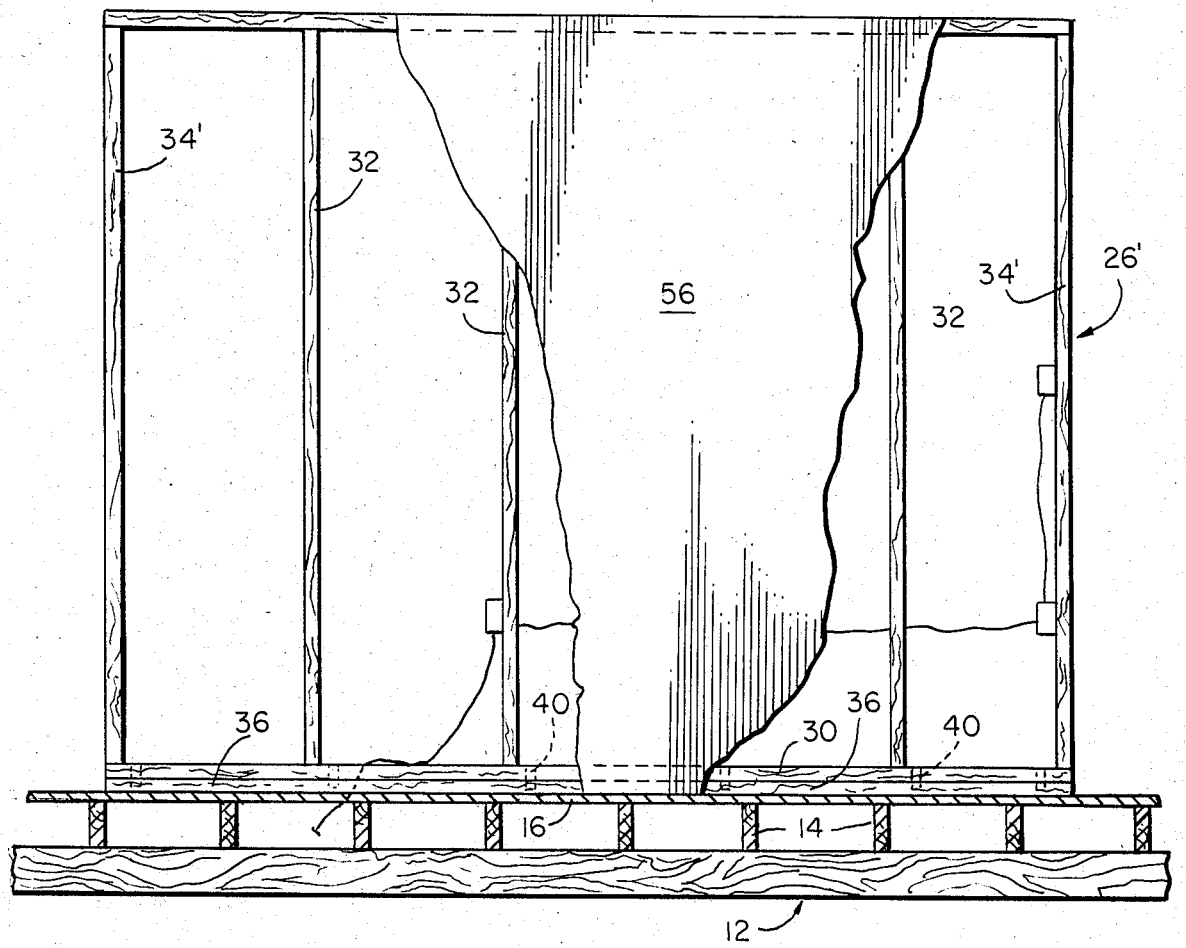
FIG. 8 is a view like FIG. 1 of a modified panel.
Figure 9:
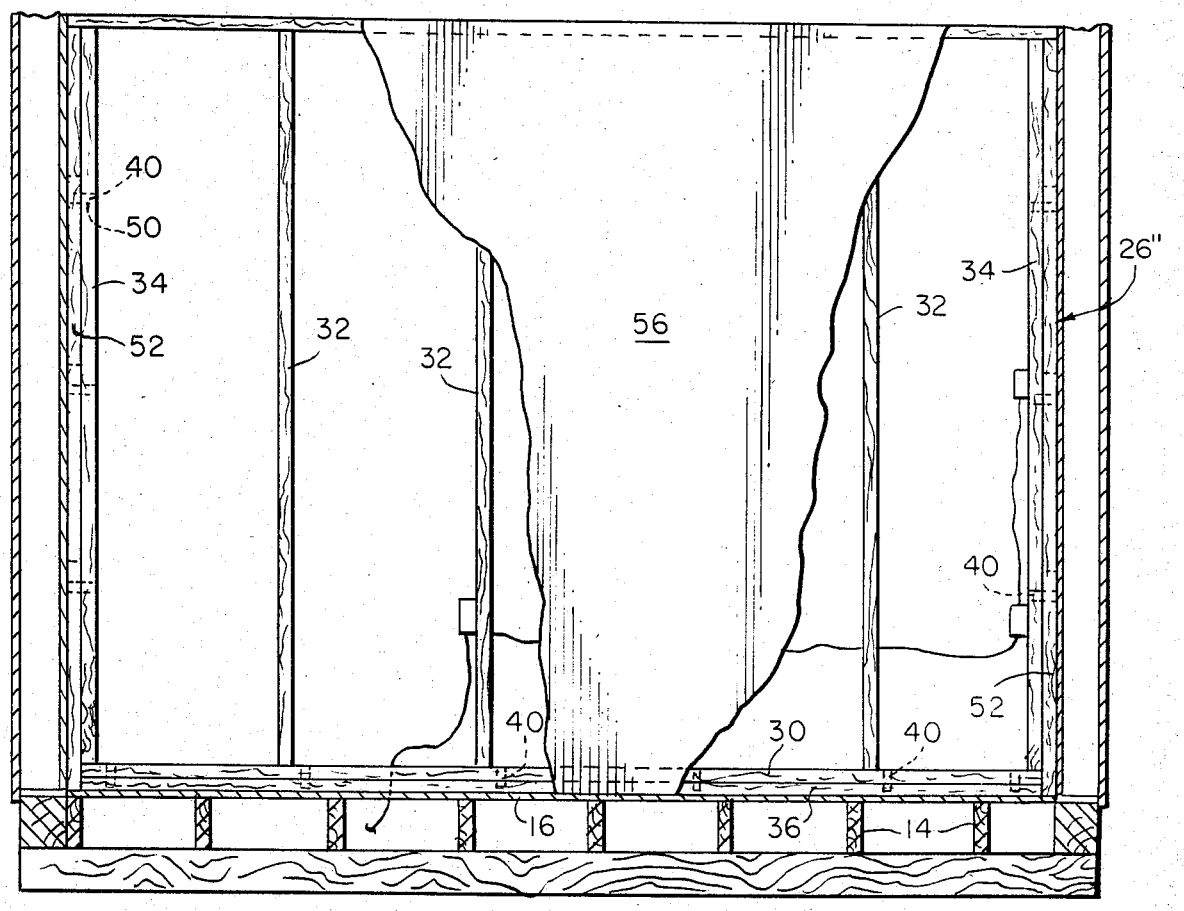
FIG. 9 is a view like FIG. 1 of another form of the partition wall of the present invention.

In respect to the pair of vertical wood end studs 34 and 34' there are 3 basic types. In one type designated 26' none of the pair of end wall studs are bored and in this instance neither end of the wall abuts another wall as shown in FIG. 8. The second type designated 26 one end of the internal panel abuts another wall as shown in FIG. 1 and the third type designated 26'' both end wall studs are bored to allow for joining the panel to another wall panel at each end as shown in FIG. 9. Referring to FIG. 3 illustrating end wall stud 34 the stud is bored as at 50. The bores 50 are preferrably not through holes and project inwardly about $1\frac{1}{4}$ inches from one face of the stud. These bores 50 receive static dowels 40 as shown in FIG. 4 of the drawings. In a preferred form of construction with a stud having a length of 95 inches 3 bores are made in the stud 24 inches apart on center.

Where the panel or interior wall 26 is to abut adjacent a transverse, for example, exterior wall panel there is nailed to the inside surface 24 of the exterior panel 24 a dead wall stud 52. It will be noted particularly from FIG. 1 that the dead wall stud 52 has a length greater than the end wall studs 34 so that the dead wall stud 52 has a length from the top of the top plate 28 to the floor 16.

Figure 2:
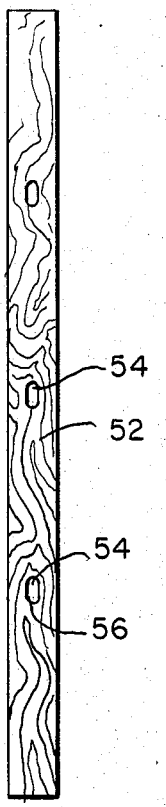
FIG. 2 is a face view of a vertical dead wall stud.
Figure 5:
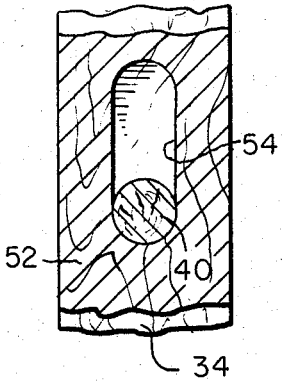
FIG. 5 is a section on line 5—5 of FIG. 4.

The vertical dead wall stud 52 is provided with through holes 54 as more particularly shown in FIG. 2. The holes 54 are oblong and the bottom portion 56 of the openings 54 are inline with the bottom of the bores 50 as clearly shown in FIGS. 4 and 5 of the drawing. The slots or openings 54 are through slots and have a width to receive the static dowels 40. In the preferred form of the invention the slots 54 have a length of $3\frac{1}{2}$ inches. The slots are important as it permits placement of the interior panel on the static dowels 40 carried by the dead floor stud 36 and at the same time to fit within the openings in the dead wall studs 52 nailed to the exterior or interior walls.

Certain of the vertical studs and/or end studs 32, 34 and 34' have mounted thereto electrical boxes 60 FIG. 1 which electrical boxes are conventionally wired with electrical cable 62, projecting outwardly therefrom.

In order to complete the interior panels the panels are faced with dry wall or paneling such as illutrated at 56 in FIGS. 1 and 6. It will be noted from FIG. 6 that the covering 56 extends below the bottom plate 30 of the panel 26 so that when the panel is seated on its dead floor stud 36 the dry wall or pending is in contact with the floor 16.

I claim:

1. An internal wall for a housing structure having a foundation, floor and exterior walls; said internal wall comprising a frame consisting of top and bottom wood plates; a pair of vertical wood end studs attached to and extending between the top and bottom plates; a plurality of intermediate vertical wood studs extending between the top and bottom plates inwardly of the pair of end studs; electrical boxes attached to selected studs; electrical wires running to said boxes and extending externally of the internal walls; wall covering means on each face of the frame; dowel receiving openings in at least the bottom plate; a dead floor stud attached to the floor along the extent of each interior wall; and wood dowels attached to the dead floor stud and projecting upwardly from the dead floor stud to receive the dowel receiving openings in the bottom plate and wherein one of said pair of end studs has a plurality of openings therein, a dowel in each of said openings and projecting outwardly therefrom; a vertical dead wall stud; a plurality of elongated slots in said dead wall stud with the bottom of the elongated slots in alignment with a corresponding bottom of a projecting dowel.

2. An internal wall for a housing structure as defined in claim 1 wherein the other of the pair of end studs is provided with a plurality of openings, dowels projecting from said openings and a further dead wall stud, said further dead wall stud having a plurality of elongated slots therethrough; said slots being sized to receive the projecting dowels from the other of the pair of end studs and the bottoms of the slots being in transverse alignment with the bottoms of the dowels.

* * * * *